United States Patent [19]

Lewis, Jr.

[11] 4,009,910

[45] Mar. 1, 1977

[54] TUFT FORMING DEVICE

[75] Inventor: John C. Lewis, Jr., Middlebury, Vt.

[73] Assignee: Tucel Industries, Inc., Middlebury, Vt.

[22] Filed: Oct. 10, 1975

[21] Appl. No.: 618,284

Related U.S. Application Data

[63] Continuation-in-part of Ser. No. 453,315, March 21, 1974, Pat. No. 3,910,637, which is a continuation-in-part of Ser. Nos. 186,659, Oct. 5, 1971, Pat. No. 3,799,616, and Ser. No. 154,055, June 17, 1971, Pat. No. 3,798,699.

[52] U.S. Cl. ..... 300/2; 300/5; 300/7; 300/19; 300/21

[51] Int. Cl.[2] ..... A46D 1/08

[58] Field of Search ..... 15/159, 159 A, 191–193; 300/2, 5, 7, 19, 21

[56] References Cited

UNITED STATES PATENTS

| | | | |
|---|---|---|---|
| 164,412 | 6/1875 | Baker | 300/19 |
| 392,420 | 11/1888 | Fish | 300/21 |
| 1,509,271 | 9/1924 | Unger | 300/21 |
| 1,741,700 | 12/1929 | Hart et al. | 300/21 |
| 2,664,316 | 12/1953 | Winslow, Jr. et al. | 300/21 |

FOREIGN PATENTS OR APPLICATIONS

| | | | |
|---|---|---|---|
| 280,372 | 11/1914 | Germany | 300/21 |
| 1,100,589 | 3/1961 | Germany | 300/5 |

*Primary Examiner*—Peter Feldman
*Attorney, Agent, or Firm*—LeBlanc & Shur

[57] ABSTRACT

This invention relates to new and useful brush making apparatus which allows the manufacture of a wide variety of different types of constructions having pretrimmed synthetic filament units. The apparatus is capable of picking and trimming all the synthetic filament required in a single tufted construction simultaneously and simultaneously assembling said filament into said construction. The apparatus comprises a filament stock box for dispensing cut-to-length synthetic filament, a new and improved picking element containing trimming and internal wedge means, which when inserted into the stock box will pick and trim the desired construction, and means for fusing the end of the picked construction and for mounting the prefused end thereof to form a filament construction.

10 Claims, 11 Drawing Figures

FIG. 8
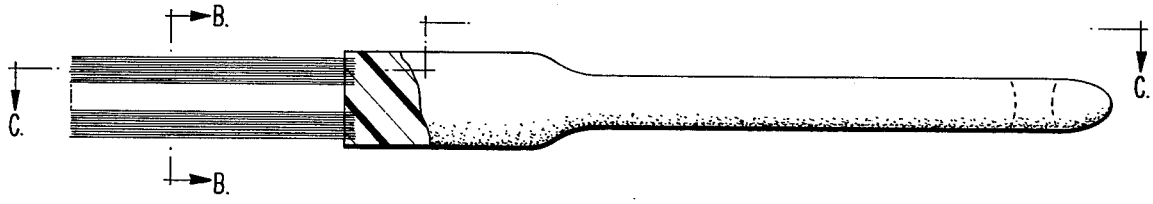
FIG. 8B
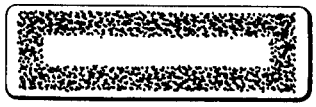
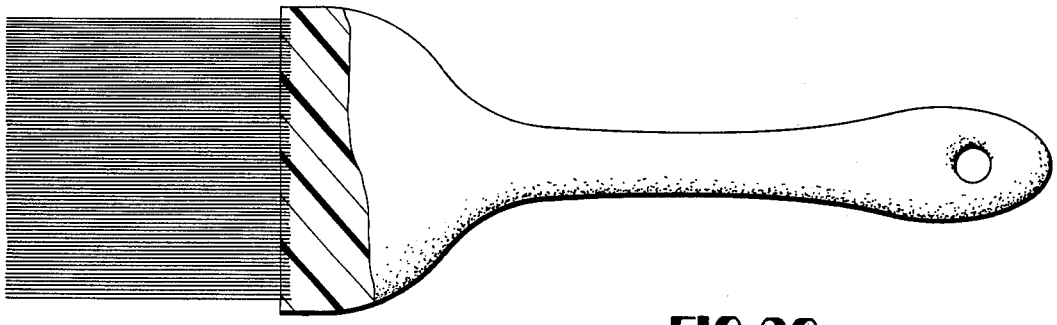
FIG. 8C

TUFT FORMING DEVICE

This application is a continuation-in-part of my copending application Ser. No. 453,315, filed Mar. 21, 1974, now U.S. Pat. No. 3,910,637 which in turn was a continuation-in-part of my copending application Ser. No. 186,659, filed Oct. 5, 1971, now U.S. Pat. No. 3,799,616 and my copending application Ser. No. 154,055, filed June 17, 1971, now U.S. Pat. No. 3,798,699. The disclosures of the aforementioned patents and patent applications are hereby incorporated by reference.

This invention relates to new and useful brush making machinery, and more specifically, to machinery for continuously fabricating synthetic filament constructions. The apparatus is particularly adapted to form a wide variety of filament constructions wherein the ends of the filament are fused and supported before they cool, so that the cooled, prefused ends only connect the filament unit and the support, or hold the filament unit onto the support.

The brush industry and the brushmaking art during the past fifty years has remained, for the most part, unchanged. The major change taking place was the substitution of synthetic compositions, i.e., nylon, polypropylene, and the like for natural filling materials, i.e., vegetable and animal fibers. These changes have been significant in view of shortages which have occurred in the natural vegetable and animal fibers. However, the plastics industry, during the early 1970's has become so affected by its dependence on oil and oil derivatives, which are now in short supply, that the synthetic filaments and molded brush backs and handles are also in short supply. It therefore becomes necessary to find new ways to construct tufted brushes and filament constructions so (1) raw material can be conserved and (2) in ways which eliminate the necessity for more than one raw material.

Picking devices for fabricating tufted construction from synthetic filaments are described in, for example, my U.S. Pat. No. 3,471,202 now U.S. Pat. No. Re. 27,455 and my U.S. Pat. No. 3,799,616, among others. However, the improved devices of the instant invention while similar in construction have the additional capability of allowing one to pick and trim hollow brush constructions wherein filament conservation and utility are achieved.

For example, conventional paint brushes have five parts: one, the handle; two, filament; three, wooden separation wedge; four, metal ferrule; and five, an adhesive as for example epoxy resin. The paint brush constructions of this invention, in contrast, comprise only a handle with filament attached thereto, both constructed preferably from polypropylene.

It will be obvious to those skilled in the art that a wide variety of different filament constructions, in addition to paint brushes, may be made utilizing the machinery of this invention to be hereinafter described.

For example, the machinery of this invention may also be adapted to form tufted constructions wherein the prefused tuft end is mounted on a heat-softened depression on a sheet or handle of the filamentary material.

Additional tufted constructions may also be formed wherein the prefused tuft end is mounted on a single strand, or on woven and nonwoven mesh. The strand or mesh may be wire, cellulosic or plastic material, and is embedded in the prefused tuft end before the end cools.

Finally, the tuft may be picked by or inserted into a sheet support exposing both the working and nonworking ends of the tuft. The nonworking end may then be heat-sealed to retain the tuft in the support.

Related articles and methods of construction are described and claimed in my U.S. Pat. Nos. 3,774,782; 3,633,974; 3,596,999; Re. 27,455; 3,604,043; and 3,641,610, and my copending application Ser. Nos. 186,659, filed Oct. 5, 1971, now U.S. Pat. No. 3,799,616, and 154,055, filed June 17, 1971, now U.S. Pat. No. 3,798,699. Accordingly, the disclosures of these aforementioned patents are hereby incorporated by reference.

Accordingly, it is therefore an object of this invention to provide new and useful brushmaking machinery adaptable for use in forming a single tuft of monofilament fiber, multiple fiber tufts, complete brush or tufted components simultaneously formed, and continuous modular brush or tufted constructions.

It is another object of this invention to provide a machine which will simultaneously pick fiber tufts having hollow centers, assemble the tuft in a predetermined pattern, and form an integral fiber tuft support modular tufted construction.

It is another object to provide a brush machine wherein the picking unit comprises one or more individual tuft pickers adapted to receive the complete fiber portion of the tufted construction to be formed simultaneously.

It is a further object of this invention to provide a machine for forming tufted constructions including means for heat-sealing the fiber tufts integral with a support.

It is a further object of this invention to provide a machine for forming tufted constructions including means for heat-sealing the fiber tufts integral with a support.

It is further an object to provide a machine for making tufted constructions which assemble cut-to-length thermoplastic fibers into fiber tufts, each of said tufts having a prefused end for mounting and a working end which does not require trimming.

It is a further object to provide a tufted paint brush construction wherein one monofilament synthetic tuft is formed, and heat-sealed, fused and mounted on a heat softened portion of a thermoplastic support of said filamentary material.

These and other object will become readily apparent with reference to the drawings and following description wherein:

FIG. 8 is a longitudinal view in partial section of a tufted paint brush made in accordance with this invention;

FIG. 8B is a cross-sectional view taken along B—B of FIG. 8;

FIG. 8C is a longitudinal view in partial section of the tufted paint brush of FIG. 8 taken along C—C.

Figure 1:
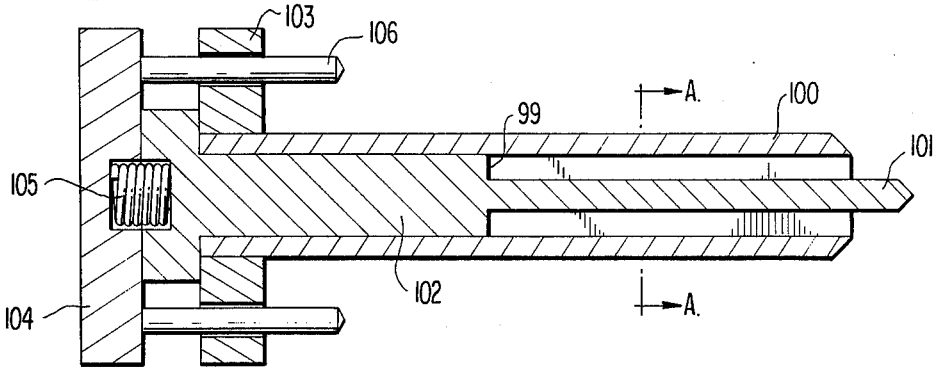
FIG. 1 is a longitudinal sectional view of a tuft forming picker of this invention.

In order to describe this invention more fully, reference is now made to specific embodiments illustrated in the drawings. This invention is directed to paint brushes and the like wherein tufted constructions are formed employing a tuft-forming picker in such a manner that tufts are simultaneously picked, simultaneously heat sealed for mounting and mounted onto a support thus forming a complete tufted construction in the same time required by a conventional brush machine to pick and staple-set one fiber tuft. This new and novel method of picking hollow fiber tufts is achieved by employing a longitudinal, generally tubular picker having a preselected cross-sectional configuration, and in a preferred embodiment, an inside sliding tuft trimming piston with an extended stationary filament separator probe with a length less than the length of the filament used in forming the tuft. The tuft forming picker of this invention is shown in FIG. 1.

The tuft-forming picker 100 of FIG. 1 is shaped as a rectangular picker in cross section. Alternative cross-sectional shapes, i.e., circular, oval, square, triangular and the like, are all possible, and are also intended to be included within the scope of this invention. This invention is not intended to be limited to the preferred cross sectional embodiment shown in FIG. 1.

Figure 1A:
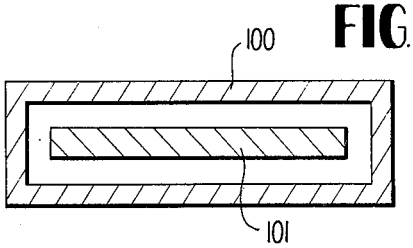
FIG. 1A is a cross-sectional view taken along A—A of FIG. 1.

The tuft-forming picker 100 of FIG. 1 has movable, sliding, tuft trimming piston 102 with the trim end located at 99, and an extended stationary probe 101. FIG. 1A shows a cross-sectional view of the picker 100 taken at A—A of FIG. 1, and illustrates the probe 101 as located inside the picker sleeve 100 but not attached thereto or touching the inner walls. Picker 100 is mounted in block 103 and supported by pins 106, said pins extending from picker unit mounting plate 104. A compressable spring 105 is located between the picker mounting unit plate 104 and sliding trim piston 102.

Figure 2:
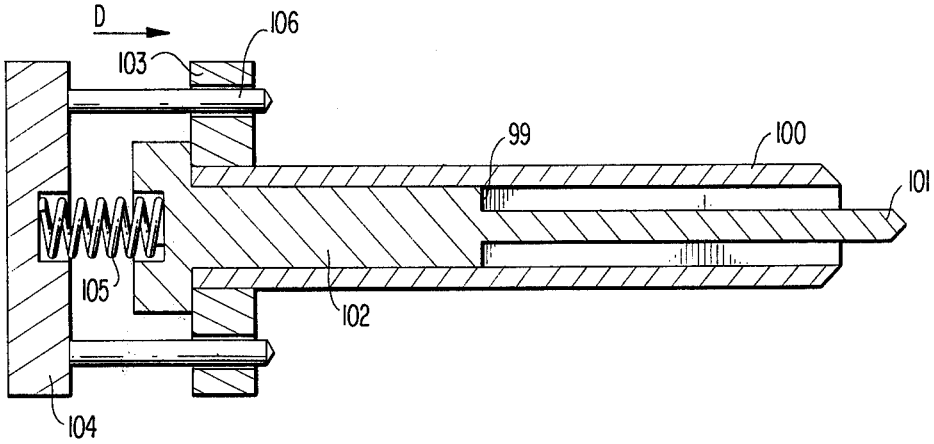
FIG. 2 is a longitudinal sectional view of the tuft forming picker of FIG. 1 in an extended attitude.

During picking, at the instant the picking device is inserted into the stock box, the picking unit is closed as shown in FIG. 1. After picking the tuft-forming sequences, the picking unit is in the open position shown in FIG. 2, whereby the sliding piston 102 is disposed forward (in direction D) by spring 105. If pressure, for any reason, is exerted on the distal, tip end of probe 101, the piston 102, carrying trim end 99 and probe 101, slides in the opposite of direction of D, against compression spring 105.

The picker of this invention retains filament within the internal walls of picker 100 by compressing said filament between the said walls and the internal probe 101, and the filament is automatically trimmed when the ends thereof abut the trim wall 99. The probe 101 is constructed so that it is shorter in length than the trim length of the synthetic filament used. For example, is the filament used had a trim length of 1⅜ inches, the inside probe 101 would be no longer than 1 13/16 inches. The length thereof, which is less than that of the filament, can, in fact, be substantially less than that of the filament. The probe, however, must be of sufficient length to protrude beyond the end of picker 100 when the picker unit is closed.

Figure 3:
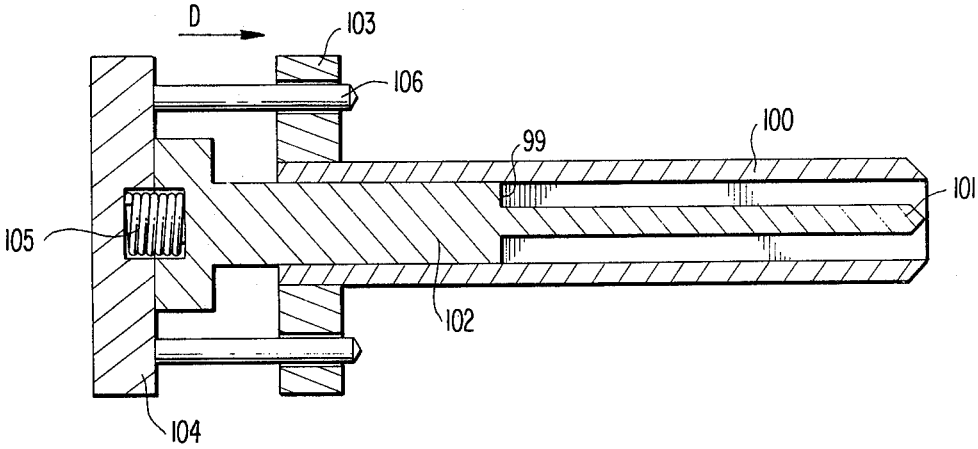
FIG. 3 is a longitudinal sectional view of the tuft forming picker of FIG. 1 with the internal filament separator probe/trim piston in an open attitude.
Figure 4:
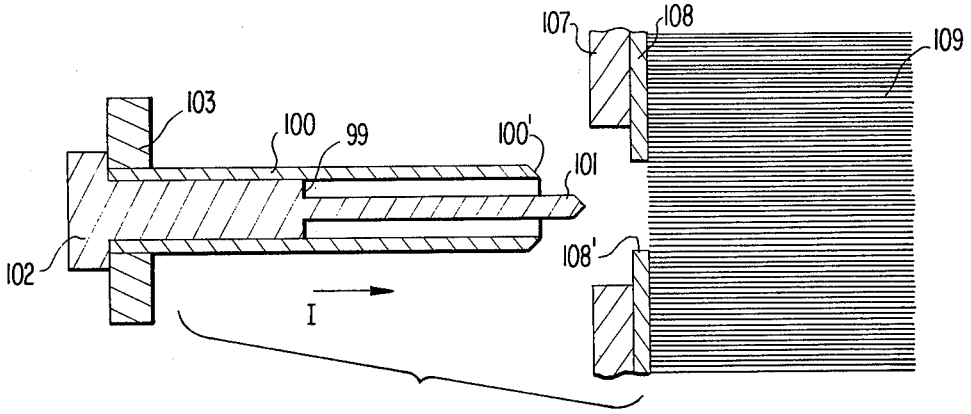
FIG. 4 is a longitudinal sectional view of a tuft forming picker in closed attitude prior to indexing into a filament stock box.

As illustrated in FIG. 3, when piston 203 is disposed in a retracted position abutting mount 104, spring 105 is compressed, and the probe end 101 is flush or slightly inside the open end of picker tube 100.

FIGS. 4–7 show, in a specific embodiment, picking a hollow tuft. When the filament is heat-fused, and the fused end of the tuft is mounted on a handle a painting tool illustrated in FIG. 8, 8B, and 8C will be formed.

Figure 5:
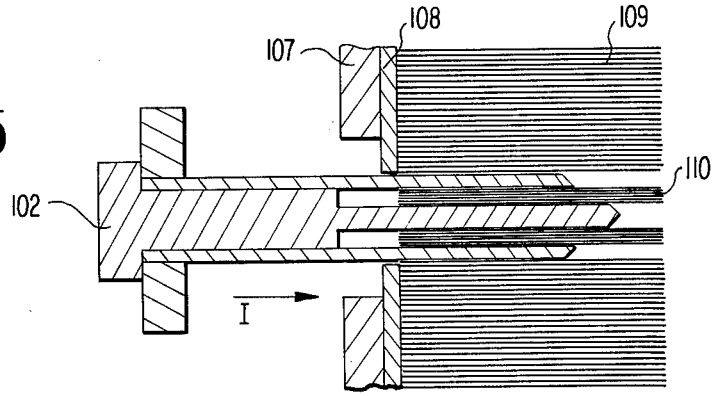
FIG. 5 is a longitudinal sectional view of the tuft forming picker of FIG. 4 as indexed into a filament stock box.

In the step of picking, sliding piston 102 is disposed forward relative to tube 100 so that the probe end 101 extends from the picker opening 100'. See FIG. 4. Filament 109 in stock box 107 is held against aperture opening 108' by diaphragm 108. As the probe 101 is indexed in the direction I, the end of probe 101 will first engage filament 109. This action causes filament 109 to separate, with some filament disposed above and some below the probe 101, as the filament 109 enters the picker 100. As picker 100 indexes further the filament 109 disposed around the aperture 108' will move away from picker 100 as shown in FIG. 5, only allowing the first engaged fiber 110 to enter the picker. When the length of the probe 101 is changed, either only a small quantity of filament will be allowed to flow into the picker, or in the alternative, too great an amount may be permitted to enter. Thus the length of the probe controls the amount of filament picked by the picker.

Figure 6:
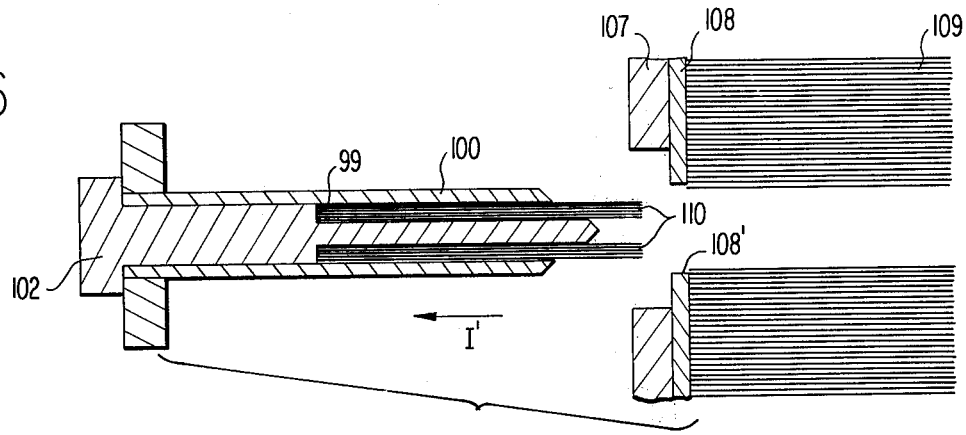
FIG. 6 is a longitudinal sectional view of the tuft forming picker of FIG. 4 as withdrawn from a filament stock box.

FIG. 6 illustrates the picked filament 110 contained in the picker 100 as trimmed against trim end 99. As shown in FIG. 6, the filament 109 not disposed in the area of the aperture 108' is retained in box 107, and as picker 100 is withdrawn in in direction I', the filament will fall, closing aperture 108' until the next pick.

Figure 7:
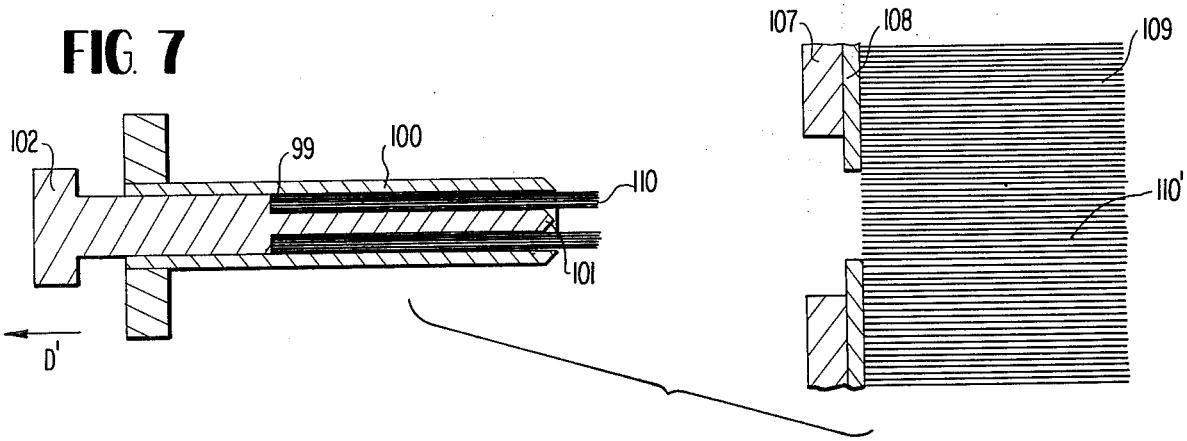
FIG. 7 is a longitudinal sectional view of the tuft forming picker of FIG. 4 as withdrawn from a filament stock box with a filament separator probe/trim pistom in an open attitude.

FIG. 7 illustrates the filled picker, with sliding piston 102 moved rearwardly to dispose probe tip 101 flush with the opening of pickers 100. The filament 110 then extends beyond the probe 101, and thus can be fused at the extended end in order to form the tuft of this invention.

FIGS. 8, 8B and 8C show how the heat-sealed tuft (filament 110 of FIG. 7) is mounted on a handle to form a paint brush. Most thermoplastic filaments have softening points which make them pliable and capable of fusing under slight pressure. In the case of oriented synthetic filaments deorientation usually begins at their softening temperature, then causing a decrease in length and an increase in diameter. Consequently, as the heated, oriented ends of the filament soften, they must be shaped and fused in order to create a self-supporting heat-sealed tuft when cool. It is usually desirable to bring the exposed filament ends 110 contained in picking device 100 in contact with a steel plate heated to for example 600°–700° F. and to allow the filament ends to remain at or near the heated plate for one to five seconds, depending upon the material, length of exposed filament, type of hollow tuft, and similar considerations. After sufficient time, the melted fused ends may be brought into contact with a cold flat surface under slight pressure to flatten and cool the melt thus forming a self supporting tuft, whereby the filament tuft base is composed of the fused filamentary material. The tuft may then be mounted on a handle in the manner described in my aforementioned copending patent application Ser. No. 453,315.

In other embodiments, the heat-softened tuft end may be retained in a heat-softened aperture or depression formed in a sheet of filamentary material or a handle, as desired.

The tuft-forming pickers of this invention as hereinabove described can be constructed from any conventional metal elements or thermoplastic materials such as polypropylene, polyacetol, polyamide and the like. The tuft-forming pickers are not limited to any given size, interval diameter or dimension, or interval cross-sectional configuration.

It has been found that the tuft-forming picker of this invention will pick tufts from assembled parallel cut-to-length synthetic fibers having any cross-sectional configuration, such as circular, X-shaped, star shaped, hollow and the like. The diameter of the fibers picked ranges from 0.005 inches to at least 0.250 inches. The length of the cut-to-length fibers can range from about 0.5 up to 30 inches. The compositions of the synthetic fiber picked and assembled into fiber tufts is not limited, and thermoplastic fibers whether oriented or unoriented can be used to form tufts in accordance with this invention. Polymers such as polyamide, polypropylene, polyethylene, copolymers for polypropylene and ethylene, polyfluoride, and the like may be employed.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. In an apparatus for making tufted constructions including a stock box for supporting parallel cut-to-length synthetic fibers, means for picking a plurality of said fibers from said stock box to form a tuft thereof, means for heat-sealing and fusing the nonworking end of said tuft, and means for mounting the nonworking end upon a support, the improvement comprising:

an elongated, hollow tuft picking element having a fiber receiving opening therein and having a preselected, internal cross-sectional configuration, said element adapted to be inserted into said stock box through an aperture therein and to receive at least the end portions of the plurality of said fibers;

trim means disposed within said element for imparting a preselected trim configuration to the ends of the tufted form therein;

ejection means carried by said element for ejecting the hollow tuft formed from said element after the exposed end thereof is heat-sealed; means carried by said ejection means for forming a hollow tuft of unsupported fibers as said fibers are received in said element.

2. The device of claim 1 wherein the ejection means comprises a piston slidably received within said element, the external configuration of said piston corresponding to the internal cross-sectional configuration of said element.

3. The device of claim 2 further comprising actuating means carried by said element for urging said piston through the interior of said element, selectively, toward or away from the opening in said element.

4. The device of claim 3 wherein said forming means comprises a probe carried by said piston and extending from the face thereof toward the opening in said element.

5. The device of claim 4 wherein the longitudinal distance from the face of said piston to the distal end of said probe is less than the length of the fibers to be picked.

6. The device of claim 5 further comprising piston actuating means, carried by said element, for selectively moving said piston from a first position wherein the distal portion of said probe extends from the opening in said element to a second position wherein the distal portion of said probe is disposed within said element.

7. The device of claim 6 wherein said trim means includes the face of said piston surrounding the proximal end portion of said probe.

8. The device of claim 6 wherein said actuating means includes bias means connecting said device and said piston for urging said piston from the first position to the second position.

9. The device of claim 1 wherein said hollow picking element has a rectangular internal cross-sectional configuration.

10. The device of claim 9 wherein said probe has a rectangular cross-sectional configuration.

* * * * *

UNITED STATES PATENT AND TRADEMARK OFFICE

CERTIFICATE OF CORRECTION

PATENT NO. : 4,009,910

DATED : March 1, 1977

INVENTOR(S) : John C. Lewis, Jr.

It is certified that error appears in the above-identified patent and that said Letters Patent are hereby corrected as shown below:

Column 3, line 68, "1 3/8 inches" should read --1 7/8 inches--

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*